US011325174B2

(12) United States Patent
Ohlscher et al.

(10) Patent No.: US 11,325,174 B2
(45) Date of Patent: May 10, 2022

(54) METHOD FOR THE CHIPLESS PRODUCTION OF A ROTATIONALLY SYMMETRICAL BODY FROM A CIRCULAR SHEET METAL BLANK

(71) Applicants: Winkelmann Powertrain Components GmbH & Co. KG, Ahlen (DE); WF-Maschinenbau und Blechformtechnik GmbH & Co. Kommanditgesellschaft, Sendenhorst (DE)

(72) Inventors: Heiko Ohlscher, Sendenhorst (DE); Christian Malkemper, Sendenhorst (DE); Bernd Rudert, Ahlen (DE); Karl-Heinz Hecker, Ahlen (DE)

(73) Assignees: Winkelmann Powertrain Components GmbH & Co. KG, Ahlen (DE); WF-MASCHINENBAU UND BLECHFORMTECHNIK GMBH & CO. KOMMANDITGESELLSCHAFT, Sendenhorst (DE)

( * ) Notice: Subject to any disclaimer, the term of this patent is extended or adjusted under 35 U.S.C. 154(b) by 511 days.

(21) Appl. No.: 16/326,423

(22) PCT Filed: Aug. 24, 2017

(86) PCT No.: PCT/EP2017/071312
§ 371 (c)(1),
(2) Date: Feb. 19, 2019

(87) PCT Pub. No.: WO2018/037070
PCT Pub. Date: Mar. 1, 2018

(65) Prior Publication Data

US 2021/0276066 A1 Sep. 9, 2021

(30) Foreign Application Priority Data

Aug. 25, 2016 (DE) ..... 10 2016 115 791.0

(51) Int. Cl.
*B21D 22/16* (2006.01)
*B21D 51/04* (2006.01)

(52) U.S. Cl.
CPC ..... *B21D 22/16* (2013.01); *B21D 51/04* (2013.01)

(58) Field of Classification Search
CPC ..... B21D 22/14; B21D 22/16; B21D 22/18; B21D 22/185; B21D 51/04
(Continued)

(56) References Cited

U.S. PATENT DOCUMENTS 4,470,281 A * 9/1984 Kaporovich ..... B21D 22/14 72/370.13
5,428,980 A * 7/1995 Iidaka ..... B21D 22/16 72/85
(Continued)

FOREIGN PATENT DOCUMENTS

DE 19620812 A1 * 10/1996 ..... B21D 22/16
DE 19703947 A1 * 7/1997 ..... B21D 22/16
(Continued)

OTHER PUBLICATIONS

Translation; DE 1970347 A1; Westermann, Jul. 1997.*
International Search Report in PCT/EP2017/071312, dated Dec. 7, 2017.

*Primary Examiner* — Edward T Tolan
(74) *Attorney, Agent, or Firm* — Collard & Roe, P.C.

(57) ABSTRACT

A method for chipless production of a rotationally symmetrical body from a circular sheet metal blank shapes the circular sheet metal blank into a pot-shaped body by pressing or pressure rolling around an inner mandrel, and a hub-shaped projection protruding outward from the base of the pot-shaped body is molded on by pressing around a central projection. The circular sheet metal blank is clamped only in the radial inner region of the blank in the axial
(Continued)

direction between the inner mandrel and at least one projection during the shaping process.

11 Claims, 2 Drawing Sheets

(58) Field of Classification Search
USPC ..... 72/83, 84, 85
See application file for complete search history.

(56) References Cited

U.S. PATENT DOCUMENTS

| | | | | |
|---|---|---|---|---|
| 5,619,879 | A | 4/1997 | Friese | |
| 9,233,413 | B2 * | 1/2016 | Zhang | B21D 53/30 |
| 2001/0015084 | A1 * | 8/2001 | Massee | B21D 22/16 72/83 |
| 2010/0011830 | A1 | 1/2010 | Huetter et al. | |
| 2012/0090372 | A1 * | 4/2012 | Nillies | B21C 37/26 72/85 |

FOREIGN PATENT DOCUMENTS

| | | | | | |
|---|---|---|---|---|---|
| EP | 0 725 693 | B1 | | 7/1997 | |
| FR | 2 559 078 | A1 | | 8/1985 | |
| GB | 2 153 278 | A | | 8/1985 | |
| GB | 2153278 | A | * | 8/1986 | B21D 22/16 |
| JP | S57 75225 | A | | 5/1982 | |
| JP | 1-228615 | A | * | 9/1989 | B21D 22/16 |
| WO | 2008/022715 | A1 | | 2/2008 | |

* cited by examiner

METHOD FOR THE CHIPLESS PRODUCTION OF A ROTATIONALLY SYMMETRICAL BODY FROM A CIRCULAR SHEET METAL BLANK

CROSS REFERENCE TO RELATED APPLICATIONS

This application is the National Stage of PCT/EP2017/071312 filed on Aug. 24, 2017, which claims priority under 35 U.S.C. § 119 of German Application No. 10 2016 115 791.0 filed on Aug. 25, 2016, the disclosure of which is incorporated by reference. The international application under PCT article 21(2) was not published in English.

BACKGROUND OF THE INVENTION

1. Field of the Invention

The invention relates to a method for chipless production of a rotationally symmetrical body from a circular sheet metal blank, wherein the circular sheet metal blank is shaped into a pot-shaped body by pressing or pressure rolling around an inner mandrel and a hub-shaped projection protruding outward from the base of the pot-shaped body is molded on by pressing around a central forepiece.

2. Description of the Related Art

Such a method is known from EP 0 725 693 B1. This known method, which in principle has long been proven, is used for production of a transmission part having a hub. In the process, a pot-shaped form is first generated from a circular sheet metal blank by pressing around an inner mandrel. Then the outer, bent-over rim region of the circular sheet metal blank is held in encircled manner by a clamping tool on the die, i.e. the rim region of the circular sheet metal blank is fixed, and so a drifting away during the ensuing pressing process is prevented. Thereupon the pot-shaped form held in this way in the rim region is reshaped into a cylindrical projection protruding from the circular sheet metal blank by pressing around a central die pin and then the cylindrical projection is opened for accommodation of a coaxial shaft.

Compared with other methods, such as welding or forging methods, this method already offers considerable advantages. Nevertheless, for holding of the circumferential rim prior to the shaping of the hub, a clamping tool bearing in encircling manner on the bent-over circumferential rim is required, which on the one hand is correspondingly laborious and on the other hand may lead to the situation that the bent-over circumferential rim held or clamped in this way may be undesirably deformed and therefore no flawless concentricity of the circumferential rim region can be assured. This is usually acceptable for the production of belt pulleys, but it makes the known method unusable if exact concentricity of the shaped regions is a concern.

A structural part for which such an exact concentricity is a concern is, for example, a housing for a pressure accumulator of an automatic transmission (especially dual clutch transmissions) or the like. In such a housing, it must be ensured that the usually cylindrical inner face is formed exactly concentrically over its entire length, so that the pressure piston being guided in the housing is guided flawlessly. Heretofore it has therefore not been possible to produce pressure accumulators of this type by chipless pressure rolling. Instead, such housings for pressure accumulators are usually produced at present by massive forming and then chip-removing machining, which is correspondingly laborious.

SUMMARY OF THE INVENTION

The task of the invention is to improve the known method, especially to simplify the production and to ensure flawless concentricity of the shaped regions.

This task is accomplished according to the invention in a method of the type designated in the introduction, by the fact that the circular sheet metal blank is clamped in axial direction throughout the entire shaping process only in its radial inner region between the inner mandrel and at least one forepiece.

According to the invention, the method is therefore carried out in only one single clamping step and the circular sheet metal blank is held or clamped only in its radial inner region; an encircling clamping tool and a clamping of the outer rim region are completely unnecessary. Thereby the method is considerably simplified and moreover, an undesired deformation of the already shaped circumferential rim is excluded. In this connection, it is essential that, starting from the circular sheet metal blank, it is not the hub first and then the pot-shaped region that are molded on, because otherwise, as has been found, the material in the hub region breaks. Since the clamping of the circular sheet metal blank takes place only in the inner region and the circular blank is reshaped exclusively by pressing or pressure rolling, a flawless concentricity of all shaped regions is ensured. The method is therefore also suitable for production of structural parts in which an exact concentricity is a concern, e.g. for production of housings for pressure accumulators. Even chip-removing post-machining of the structural part is not necessary.

For this purpose, it is provided that, during pressing, the circular sheet metal blank is held around the central forepiece only by the central forepiece and the inner mandrel. During the hub shaping, the circular sheet metal blank is therefore held only radially inside the hub to be generated.

Depending on size of the hub to be molded on and thus of the central forepiece, it may also be sufficient, during pressing or pressure rolling around the inner mandrel for formation of the pot-shaped body, for the circular sheet metal blank to be held only by the central forepiece and the inner mandrel. Usually, however, it is preferred that the circular sheet metal blank be held, during shaping around the inner mandrel, by an outer forepiece surrounding the central forepiece, wherein, during use of such an annular outer forepiece, the central forepiece may be moved axially out of the contact position on the circular sheet metal blank.

Depending on rotationally symmetric body to be fabricated and especially on its axial length, it is preferably provided that the circular sheet metal blank firstly be shaped into a pot-shaped preform in a first pressing process.

In a first configuration, it is then preferably provided that then the pot-shaped preform is shaped by pressure rolling into a pot-shaped final form, after which the hub-shaped projection is molded on.

Alternatively, it may be preferably provided that, after formation of the pot-shaped preform, the hub-shaped projection is molded on by pressing and then the pot-shaped preform is shaped by pressure rolling into a pot-shaped final form.

The method may be carried out in principle using a flat circular sheet metal blank. In one configuration, however, it is provided that, prior to the pressing of the pot-shaped preform, the circular sheet metal blank is equipped with a chamfered circumferential rim. This may be done, for example, by deep-drawing or any other suitable shaping method.

Quite particularly preferably, it may be provided that, prior to the pressing of the pot-shaped preform, the circular sheet metal blank is equipped with a central bore.

Depending on material selection and structural part to be shaped, it may be further preferably provided that, prior to and/or during pressing or pressure rolling, the circular sheet metal blank is preheated, e.g. by induction.

The pot-shaped final form may be of cylindrical or even conical structure.

It may also be advantageously provided that an inner mandrel having longitudinal grooves is used. Thereby ridges and grooves are automatically generated on the inner circumferential region of the structural part.

Furthermore, it may also be advantageously provided that a central forepiece having a surface profiling is used. The inner region of the pushed-on hub may then have different geometric shapes, i.e. as a hexagon socket, torx profile or the like. This can be realized easily by appropriate surface profiling of the central forepiece.

BRIEF DESCRIPTION OF THE DRAWINGS

By way of example, the invention will be explained in more detail in the following on the basis of the drawing. Therein, respectively in a longitudinal section.

Figure 2:
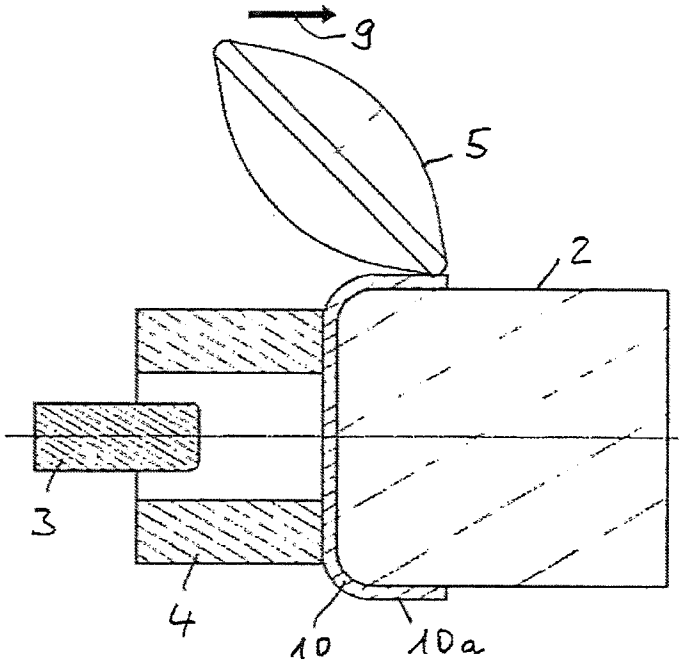
FIG. 2 shows the reshaping of a circular sheet metal blank into a pot-shaped preform by pressing.

In the drawings, a pressing/shaping jig denoted in general by 1 is illustrated only with the elements essential for the invention. The pressing/forming jig 1 is configured in rotationally symmetrical manner around a longitudinal axis A and has a substantially cylindrical inner mandrel 2. A forepiece, which in the exemplary example is formed as in two parts, namely has a central forepiece 3 and an outer annular forepiece 4 surrounding the central forepiece 3, is disposed on the opposite side of the axial end 2*a* of the inner mandrel 2. Both the central forepiece 3 and the outer forepiece 4 are designed to be movable both ways in axial direction.

DETAILED DESCRIPTION OF THE PREFERRED EMBODIMENTS

Furthermore, the pressing/shaping jig 1 has pressure rollers 5, 6 and 7, wherein several pressing rollers 5, 6, 7 may also be provided in a manner distributed over the circumference. The pressure rollers 5, 6, 7 are disposed in known manner opposite the forepieces 3 and 4 as well as the inner mandrel 2 such that they can rotate relative thereto, wherein the angular orientation and the geometric shape of the respectively desired pressure rollers 5, 6, 7 are adapted to the respective pressure-rolling process, i.e. to the desired shape and dimension of the rotationally symmetrical body to be produced.

Figure 1:
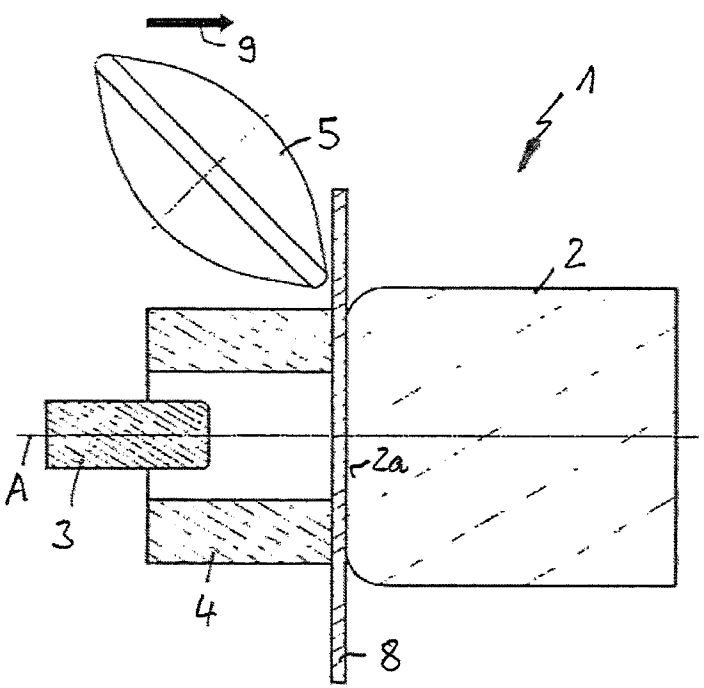
FIG. 1 shows a circular sheet metal blank received in a pressing/shaping jig prior to the beginning of the shaping.

For implementation of the method according to the invention, a circular sheet metal blank 8 is clamped according to FIG. 1 between the outer forepiece 4 and the axial end 2*a* of the inner mandrel 2, by pressing the outer forepiece 4 in axial direction against the circular sheet metal blank 8 and thus the inner mandrel 2. Then the pressure roller 5 (or several pressure rollers 5) is set into rotational movement opposite the circular sheet metal blank 8 and thus the forepiece 4 and the inner mandrel 2, and at the same time the pressure roller 5 is moved in the direction of the arrow 9. Thereby a pot-shaped preform 10, which has an axially elongated region 10*a* on the outer circumference, is formed from the circular sheet metal blank 8. In the process, the circular sheet metal blank 8 is obviously held or clamped only in its radially inner region between the inner mandrel 2 and the outer forepiece 4.

Thereafter the pot-shaped preform 10 is shaped with a second pressure roller 6 (or several pressure rollers 6) into a pot-shaped final form 11, by moving the pressure rollers 6 axially in the direction of the arrow 12 under simultaneous relative rotational movement opposite the outer forepiece 4 and the inner mandrel 2; this pot-shaped final form 11 has a substantially longer, axially elongated circumferential region 11*a* than does the pot-shaped preform 10.

Thereafter the central forepiece 3 is moved axially in the direction of the arrow 13 toward the inner mandrel 2 and clamps the pot-shaped final form 11 in its radial inner region against the inner mandrel 2. Following this, the outer forepiece is moved axially outward in the direction of the arrow 13 and, in fact, so that that one or more pressure rollers 7 can be moved radially inward in the direction of the arrow 14. By simultaneous rotational movement of the pressure roll 7, a hub-shaped projection 16 is molded around the central forepiece 3 on the rotationally symmetrical body 17, which in this way becomes finished.

Throughout the entire method workflow, the circular sheet metal blank 8 or the pot-shaped preform 10 obtained from it, the pot-shaped final form 11 and the end product, namely the rotationally symmetrical body 17, are held only in the radial inner region between the inner mandrel 2 and the central forepiece 3 or the outer forepiece 4.

Figure 4:
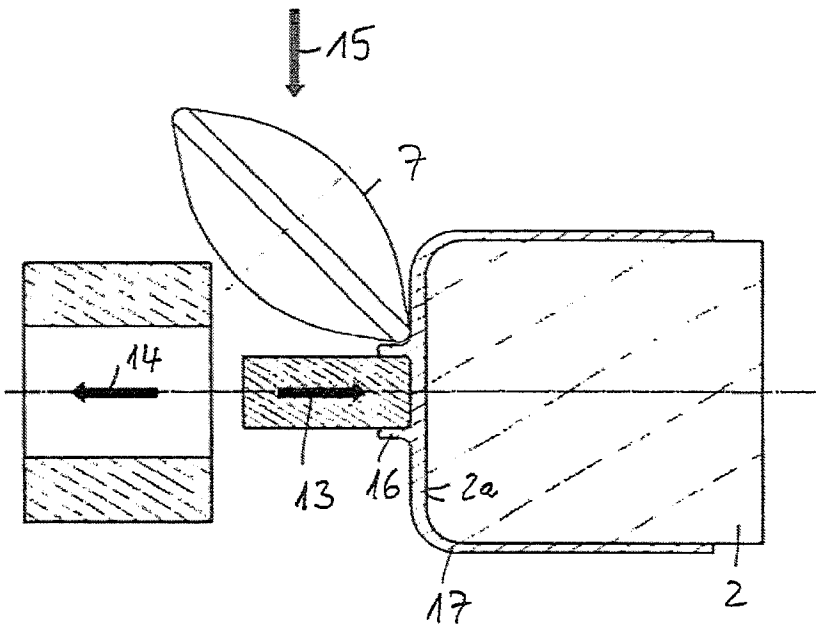
FIG. 4 shows the molding-on of a hub-shaped projection by pressing.
Figure 3:
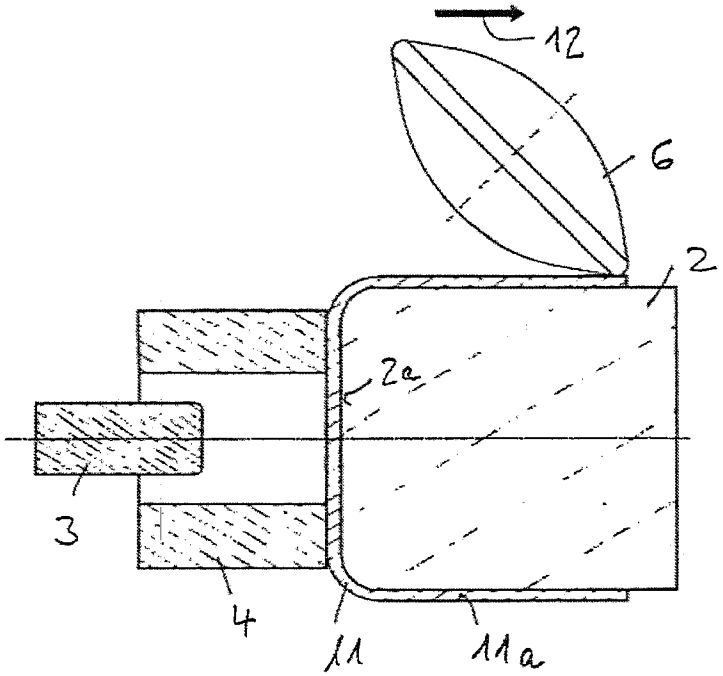
FIG. 3 shows the reshaping of a circular sheet metal blank into a pot-shaped final form by pressure rolling.

The method workflow may also be modified to the effect that the sequence of FIGS. 3 and 4 is inverted, i.e. that the after formation of the pot-shaped preform 10, the hub-shaped projection 16 molded on in the sense of FIG. 4 and then the pot-shaped final form 11 in the sense of FIG. 3.

Instead of a flat circular sheet metal blank 8, a circular sheet metal blank equipped with a chamfered circumferential rim may also be used as starting product for the method workflow. Furthermore, prior to the pressing of the pot-shaped preform, the circular sheet metal blank may also be equipped with a central bore.

Moreover, it may be provided that, prior to and/or during pressing or pressure rolling, the circular sheet metal blank 8 is preheated.

LIST OF REFERENCE SYMBOLS

A Longitudinal axis
1 Pressing/shaping jig
2 Inner mandrel
2*a* Axial end
3 Central forepiece
4 Outer forepiece
5, 6, 7 Pressure rollers
8 Circular sheet metal blank
9 Arrow
10 Pot-shaped preform
10*a* Axially elongated region
11 Pot-shaped final form

11*a* Axially elongated region
12 Arrow
13 Arrow
14 Arrow
15 Arrow
16 Hub-shaped projection
17 Rotationally symmetrical body

The invention claimed is:

1. A method for non-cutting production of a rotationally symmetrical body from a circular sheet metal blank, the method comprising:

clamping the circular sheet metal blank in an axial direction only in a radial inner region of the circular sheet metal blank between an inner mandrel and an outer forepiece surrounding a central forepiece;

in a first spinning process, forming the circular sheet metal blank into a pot-shaped preform only by spinning or flow-forming around the inner mandrel, wherein the circular sheet metal blank is held during the forming around the inner mandrel only by the outer forepiece;

shaping the pot-shaped preform into a pot-shaped body by spinning or flow-forming around the inner mandrel;

subsequently moving the central forepiece axially towards the inner mandrel to clamp the pot-shaped preform in a radially inner region of the pot-shaped preform against the inner mandrel by the central forepiece;

moving the outer forepiece axially away from the inner mandrel and moving one or more spinning rollers radially inwards; and forming a hub-shaped projection protruding outward from a base of the pot-shaped body by spinning around the central forepiece.

2. The method according to claim 1, wherein the circular sheet metal blank is held only by the central forepiece and the inner mandrel during spinning around the central forepiece.

3. The method according to claim 2, wherein the pot-shaped preform is formed into a pot-shaped final form and thereafter the hub-shaped projection is formed on.

4. The method according to claim 2, wherein after the pot-shaped preform has been formed, the hub-shaped projection is formed on and thereafter the pot-shaped preform is formed into a pot-shaped final form.

5. The method according to claim 1, wherein the pot-shaped preform is formed into a pot-shaped final form and thereafter the hub-shaped projection is formed on.

6. The method according to claim 1, wherein after the pot-shaped preform has been formed, the hub-shaped projection is formed on, and thereafter the pot-shaped preform is formed into a pot-shaped final form.

7. The method according to claim 1, wherein before the pot-shaped preform is formed, the circular sheet metal blank is provided with a chamfered peripheral edge.

8. The method according to claim 1, wherein before the pot-shaped preform is formed, the circular sheet metal blank is provided with a central bore.

9. The method according to claim 1, wherein the circular sheet metal blank is preheated before and/or during spinning or flow-forming.

10. The method according to claim 1, wherein an inner mandrel having longitudinal grooves is used.

11. The method according to claim 1, wherein a central forepiece having a surface profiling is used.

* * * * *